US006731080B2

(12) United States Patent
Flory

(10) Patent No.: US 6,731,080 B2
(45) Date of Patent: May 4, 2004

(54) MULTIPLE BALLAST AND LAMP CONTROL SYSTEM FOR SELECTIVELY VARYING OPERATION OF BALLASTS TO DISTRIBUTE BURN TIMES AMONG LAMPS

(75) Inventor: Isaac L. Flory, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/184,056

(22) Filed: Jun. 28, 2002

(65) Prior Publication Data

US 2004/0000881 A1 Jan. 1, 2004

(51) Int. Cl.[7] ..... H05B 37/00

(52) U.S. Cl. ..... 315/312; 315/323; 315/324; 315/320

(58) Field of Search ..... 315/312–314, 315/316, 320, 322, 324, 360, 362, 250

(56) References Cited

U.S. PATENT DOCUMENTS

| | | | | |
|---|---|---|---|---|
| 3,971,028 A | | 7/1976 | Funk | 343/225 |
| 4,001,571 A | | 1/1977 | Martin | 240/9 R |
| 4,242,614 A | | 12/1980 | Vatis et al. | 315/153 |
| 4,463,287 A | | 7/1984 | Pitel | 315/291 |
| 4,500,796 A | | 2/1985 | Quin, deceased | 307/147 |
| 5,003,227 A | | 3/1991 | Nilssen | 315/161 |
| 5,079,485 A | | 1/1992 | Hasemann et al. | 315/324 |
| 5,621,282 A | | 4/1997 | Haskell | 315/324 |
| 5,811,940 A | | 9/1998 | Nutzel | 315/291 |
| 5,936,362 A | * | 8/1999 | Alt et al. | 315/312 |
| 5,990,635 A | | 11/1999 | Ference et al. | 315/362 |
| 6,008,586 A | | 12/1999 | Norman | 315/94 |
| 6,037,721 A | | 3/2000 | Lansing et al. | 315/295 |
| 6,137,239 A | | 10/2000 | Wu et al. | 315/291 |
| 6,181,086 B1 | | 1/2001 | Katyl et al. | 315/307 |
| 6,188,181 B1 | * | 2/2001 | Sinha et al. | 315/293 |
| 6,252,358 B1 | | 6/2001 | Xydis et al. | 315/295 |
| 6,310,440 B1 | | 10/2001 | Lansing et al. | 315/149 |
| 2001/0040805 A1 | | 11/2001 | Lansing et al. | 362/276 |

* cited by examiner

*Primary Examiner*—Don Wong
*Assistant Examiner*—Tuyet T. Vo
(74) *Attorney, Agent, or Firm*—Stacey J. Longanecker; Alfred N. Goodman

(57) ABSTRACT

A control device and signaling are provided to operate selected numbers of the ballasts in a multi-ballast, multi-lamp luminaire. The luminaire has a control input for receiving a control signal from a wall switch, for example. The number of ballasts operated by the luminaire increases or decreases sequentially in response to one of consecutive pulses, signal level transitions or interrupts in the control signal. The control device can be programmable or hard-wired to the relays (e.g., a counter and decoder) to allow for a more economical implementation. Different subsets of the ballasts can be selected via the programmable integrated circuit to distribute the burn times of the lamps.

19 Claims, 6 Drawing Sheets

10
20
LUMINAIRE
20
12
CONTROL DEVICE
DC SUPPLY
14a
14b
14c
14d
R
16a
16b
16c
16d
BALLAST
18a1
18an
18b1
18bn
18c1
18cn
18d1
18dn
L
24
26
USER CONTROL INTERFACE
L
N
G
AC POWER

FIG. 3

RELAY ( #1, #2, #3, #4 )

| A \ BC | 00 | 01 | 11 | 10 |
|---|---|---|---|---|
| 0 | 0000 | 1111 | 0000 | 1100 |
| 1 | 1000 | 0000 | 0000 | 1110 |

FIG. 5

RELAY ( #1, #2, #3, #4 )

| A \ BC | 00 | 01 | 11 | 10 |
|---|---|---|---|---|
| 0 | 0000 | 0001 | 0000 | 0111 |
| 1 | 1111 | 0000 | 0000 | 0011 |

MULTIPLE BALLAST AND LAMP CONTROL SYSTEM FOR SELECTIVELY VARYING OPERATION OF BALLASTS TO DISTRIBUTE BURN TIMES AMONG LAMPS

FIELD OF THE INVENTION

The present invention relates generally to a control device for essentially any illumination device or system comprising multiple ballasts and multiple lamps. More particularly, the present invention relates to a dimming apparatus for gas discharge or incandescent luminaires having multiple ballasts and lamps therein that enables selected ones of the ballasts and their associated lamps to control the illumination level of a specific area

BACKGROUND OF THE INVENTION

Different tasks require various levels of illumination. For example, an office worker may desire brighter illumination over his desk than a computer operator would want over his computer console.

Dimming devices have been proposed to adjust the lumen level of light sources. For example, a wireless lighting control system can employ a radio frequency (RF) transmitter and receiver to adjust the illumination level of a light source(s) for a particular area. However, this type of RF control system has drawbacks. Specifically, the luminaires may not always receive the RF signaling from the transmitter, and so the lumen level may not be adjusted as desired. Accordingly, factors such as signal strength (e.g., the proximity of the transmitter to the receiver) becomes an issue for adjusting the illumination level. This can be a significant problem in a facility where the luminaires are suspended from the ceiling (e.g., on the order of thirty feet or more above the ground) and are difficult to reach for maintenance purposes. Many RF control systems employ sequential circuit operation and control signaling to benefit from the simplicity of only having to use one specific RF signal for the control command. Assuming a sequential control circuit is used, if one luminaire is unable to receive signals re-transmitted from the transmitter of another luminaire, and therefore does not extinguish or enable its lamps to adjust the lumen level as desired, that luminaire can become out of sequence with the other luminaires in the facility, causing improper lighting. To correct such a problem, all of the luminaires would have to be cycled off and then on, and the RF receiver(s) and transmitter(s) repositioned in order to obtain better reception within the RF control system of the luminaires. Accordingly, a need exists for a lighting control system that is hard-wired with respect to the luminaires and provides accurate and consistent lumen level adjustment within the operating area.

In addition, existing lighting control systems are disadvantageous because they generally employ sequencing through predetermined steps to power up and power down selected ones of a plurality of lamps. Some lamps are therefore subjected to shorter burn times than other lamps. For example, in a luminaire having eight lamps that are controlled by four two-lamp ballasts, the typical cycle is operate none of the lamps, two of the lamps, four of the lamps, six of the lamps, or all eight of the lamps, depending on how may signals are sent by the radio transmitter. When only two lamps are desired, the same two lamps are typically powered on, while the remaining lamps are powered down. Similarly, when only four or six of the lamps are desired, the same subsets of lamps are selected, while the remaining lamps are subjected to less burn time. Using fixtures wherein some lamps age more rapidly than others presents maintenance problems. A need therefore exists for a lighting control system that rotates use of each of the lamps in a multiple-ballast and multiple-lamp luminaire to more evenly distribute their burn times.

SUMMARY OF THE INVENTION

In accordance with the present invention, a lighting control system is provided to selectively operate ballasts in a multi-ballast, multi-lamp luminaire via relays to control the lumen output level of the luminaire.

In accordance with an aspect of the present invention, the lighting control system employs a sequential control device and signaling to operate selected numbers of the ballasts in a multi-ballast, multi-lamp luminaire.

In accordance with another aspect of the present invention, the luminaire is provided with a control input for receiving a control signal. The control signal can be generated via a wall-mounted switch or other device operable to generate an output signal. The number of ballasts operated by the luminaire increases or decreases sequentially in response to one of consecutive pulses, signal level transitions or interrupts in the control signal.

In accordance with another aspect of the present invention, the control device is hard-wired to the relays (e.g., a counter and decoder combination) to obviate the need for a programmable integrated circuit and allow for a more economical implementation.

In accordance with yet another aspect of the present invention, the control device is a programmable integrated circuit that provides for operation of selected numbers of the ballasts in response to a control signal. Different subsets of the ballasts can be selected to distribute the burn times of the lamps.

In accordance with still yet another aspect of the present invention, the lighting control system can arrange addressable luminaires in different zones and addresses for selected luminaires can be transmitted via the control signal. The programmable integrated circuit can also track actual burn times of luminaires and use this information to select which ballasts to operate.

In accordance with an embodiment of the present invention, a luminaire having a plurality of ballasts connected to a plurality of lamps is provided which further comprises: (1) a plurality of relays connected to respective ones of the plurality of ballasts; (2) a control device connected to each of the plurality of relays; and (3) a control input for providing a control signal to the control device. The control device comprises a counter for counting and generating an output signal in response to the control signal, and a decoder configured to receive the output signal and sequentially select which of the plurality of relays to actuate, thereby operating the corresponding ones of the plurality of ballasts in response to the output signal. The control signal is a DC signal comprising pulses. The counter is operable to increment the output signal in response to each pulse. The decoder is configured to implement a truth table whereby all of the plurality of ballasts are powered on in response to a first one of the pulses, and then one or more subsets of the plurality of ballasts are powered down in response to subsequent ones of the pulses until all of the plurality of ballasts are powered down.

In accordance with another embodiment of the present invention, the decoder is configured to implement a truth table whereby all of the plurality of ballasts are powered down in response to a first one of the pulses, and then one or more subsets of the plurality of ballasts are powered on in response to subsequent ones of the pulses until all of the plurality of ballasts are powered on.

In accordance with another embodiment of the present invention, a luminaire having a plurality of ballasts connected to a plurality of lamps is provided and further comprises: (1) a plurality of relays connected to respective ones of the plurality of ballasts; (2) a control device connected to each of the plurality of relays; and (3) a control input for providing a control signal to the control device. The control device comprises a programmable controller that is programmed to sequentially select which of the plurality of relays to actuate and thereby operate the corresponding ones of the plurality of ballasts in response to the control signal. The programmable controller is operable to select which of the plurality of ballasts to operate to distribute the burn times of the plurality of lamps.

BRIEF DESCRIPTION OF THE DRAWINGS

These and other aspects, advantages and novel features of the invention will be more readily appreciated from the following detailed description when read in conjunction with the accompanying drawings, in which:

FIG. 3 is a truth table employed by a ballast control device in accordance with an embodiment of the present invention;

FIG. 5 is a truth table employed by a ballast control device in accordance with an embodiment of the present invention;

DETAILED DESCRIPTION OF THE PREFERRED EMBODIMENTS

Figure 1:
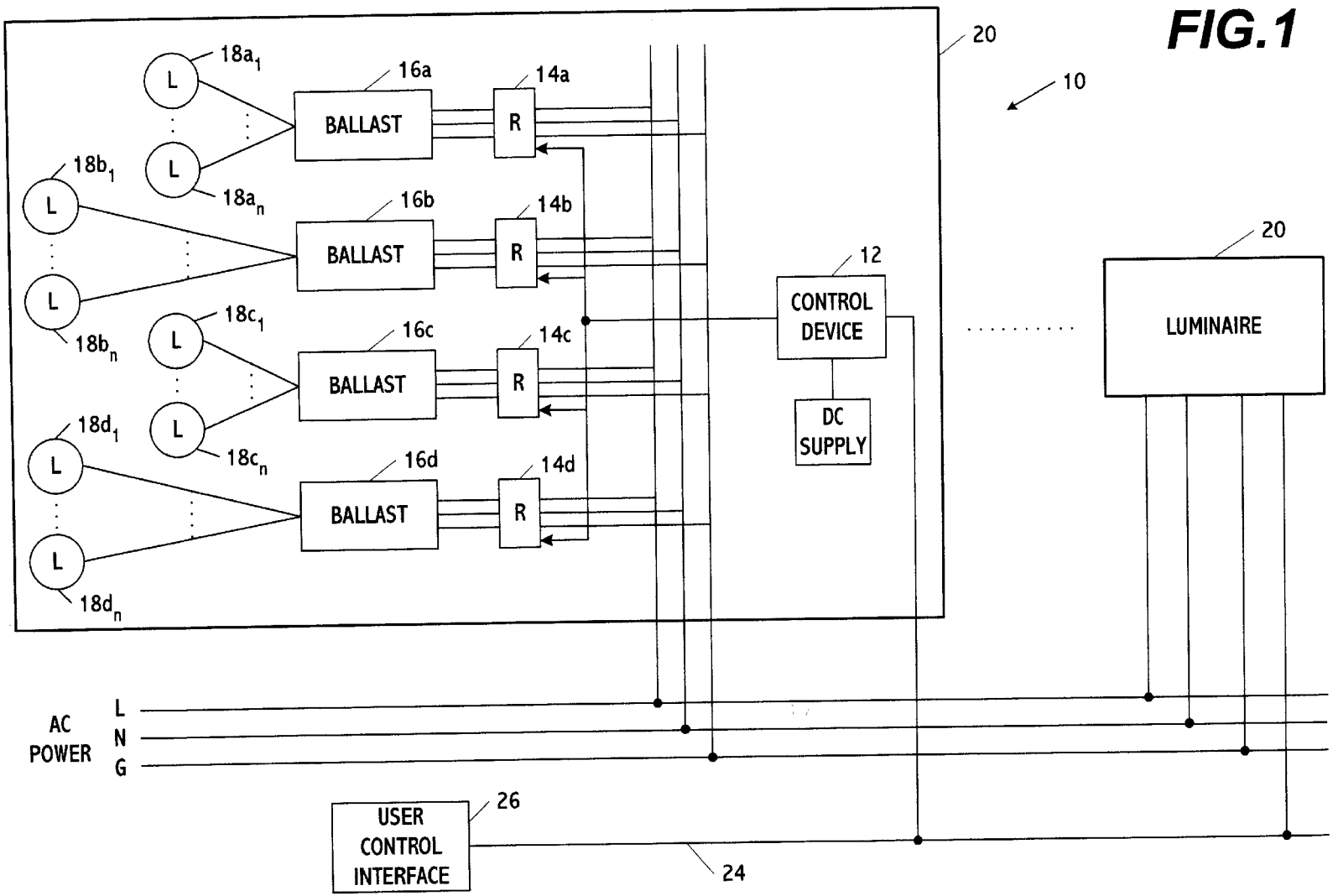
FIG. 1 is a block diagram of a lighting control system constructed in accordance with an embodiment of the present invention.

FIG. 1 is a block diagram of a lighting control system 10 constructed in accordance with an embodiment of the present invention. The lighting control system 10 comprises a control device 12 for selectively operating a plurality of relays indicated generally at 14. By way of an example, four relays 14*a*, 14*b*, 14*c* and 14*d* are connected to respective ballasts 16*a*, 16*b*, 16*c* and 16*d*. The relays 14*a*, 14*b*, 14*c* and 14*d* are controllably actuated to selectively power up and power down respective ballasts 16*a*, 16*b*, 16*c* and 16*d* and, correspondingly, lamps connected to the ballasts. The lamps are indicated generally at 18 and can be incandescent lamps or gas discharge lamps such as fluorescent, metal halide or high pressure sodium lamps. The lamps 18 and ballasts 16 are preferably provided in a multiple-ballast and multiple-lamp luminaire 20; however, the ballasts can also be shared between two or more multiple-lamp luminaires. The lighting control system 10 can be used with any high intensity discharge or fluorescent lamp luminaire that uses multiple lamps and more than one ballast.

With continued reference to FIG. 1, each luminaire 20 is provided with AC power, as indicated by the line (L), neutral (N) and ground (G) lines in this embodiment. It is to be understood, however, that the power supply can employ line (L1), line (L2) and ground (G). Each luminaire 20 is preferably also provided with a control input 24 which can be, for example, a single wire or a pair of wires. As will be described in more detail below, the control input transports a control signal (e.g., a DC signal) that indicates the desired illumination level to the control device 12 which, in turn, responds by actuating the relay(s) 14 corresponding to selected ballasts 16.

The control input 24 is connected to a user control interface 26 which can be, for example, a conventional wall-mounted light switch such as a toggle (ON/OFF) switch, a slide switch, or a dial. The user control interface can also be a clock or other device that generates an output signal. In the illustrated embodiment, the control signal generated by the user control interface 26 is a DC signal that is high or low, depending on the state of the user control interface. For example, the control signal can be high each time a toggle switch is placed in the ON position and low each time the toggle switch is placed in the OFF position. The control device 12 then interprets each change in the state of the control signal on the control input 24 as a request to power on or power down one or more of the ballast(s) 16.

As shown in FIG. 1, the relays 14 can be employed to switch power to the ballasts 16 to selectively power up and power down the ballasts. Alternatively, the ballasts 16 can be electronic-type ballasts, and the relays 14 can be employed to switch low voltage control signals to the ballasts 16 to selectively power up and power down their respective lamps 18.

As shown in FIG. 1, the luminaires 12 can be cascaded. In other words, the same control input 24 can be provided to more than one luminaire 12. In addition, a control input 24 can be provided with more than one user control interface 26 such that activation of any of the user control interfaces 26 serves as an indication to power down or power up one or more of the ballasts in each of the luminaires 20 connected to that control input 24. As described in more detail below, the control device 12 can be programmable such that each luminaire 20 is addressable within a group of luminaires via the control input 24. Each luminaire can also be controlled as part of plural and addressable groups of luminaires. For example, luminaires can be arranged in zones and one luminaire can be a member of more than one zone of luminaires.

For illustrative purposes, an exemplary luminaire 20 is described herein which has four ballasts 16 that each provide power to two lamps 18. The luminaire 20 can therefore operate in one of five states, that is, all eight lamps are on, six lamps are on, four lamps are on, two lamps are on or none of the lamps are on. Rather than hardwiring four independent circuits into the luminaire 20, the luminaire is provided with a single control device 12 and relays 14 to control which ballasts 16 are powered on via control logic.

Figure 2:
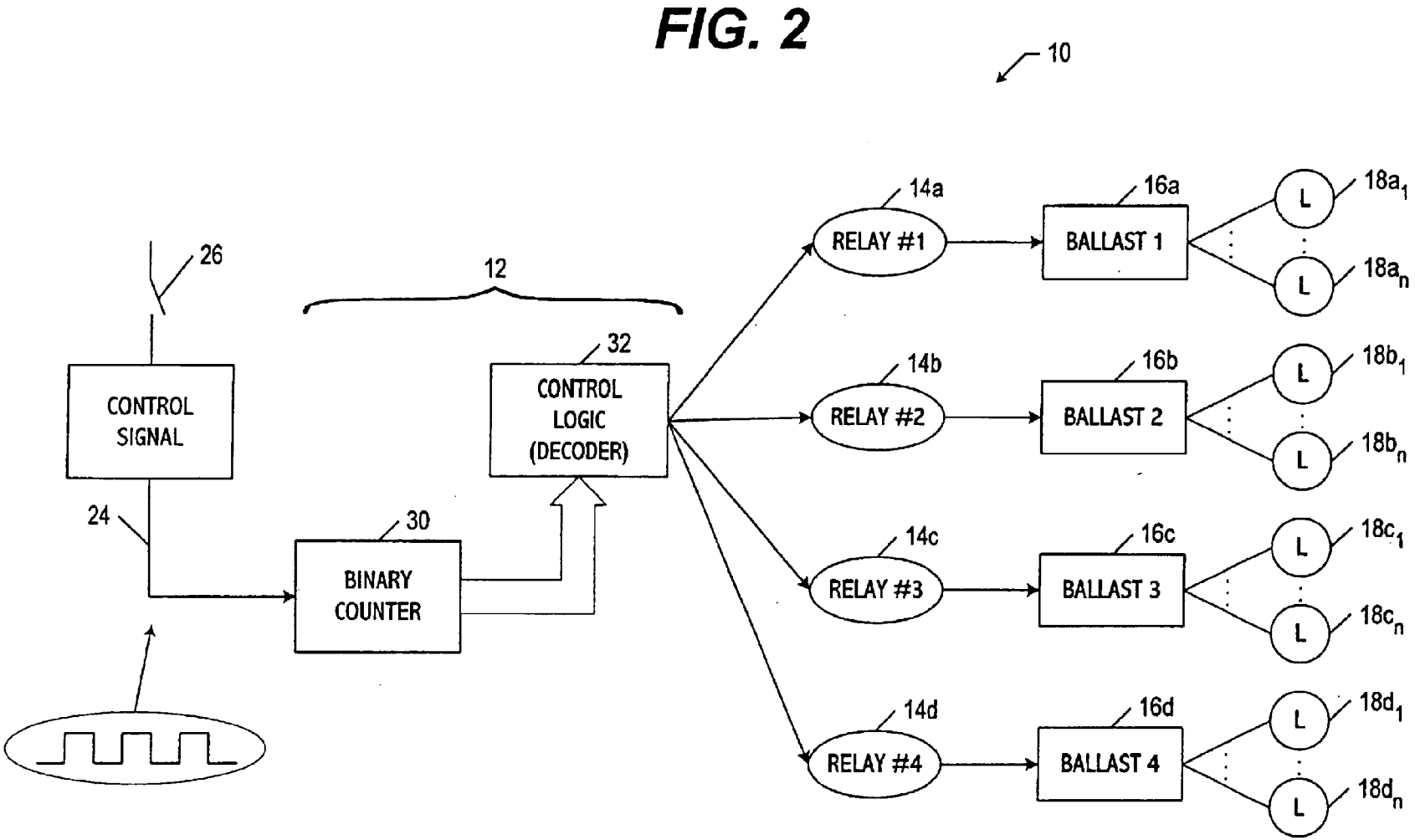
FIG. 2 is a block diagram of a ballast control device constructed in accordance with an embodiment of the present invention.

In accordance with one embodiment of the present invention, the control device 12 is implemented using a counter 30 and a decoder 32 to determine which of the ballasts 16 in a multi-ballast and multi-lamp luminaire 20 are to operate via a corresponding one of the relays 14, as shown in FIG. 2. In the illustrated embodiment, the control signal has voltage pulses corresponding to the number of times a user toggled a wall switch 26, for example. The control signal is provided to the counter 30, which generates an output that can be decoded by the decoder 32. A hexadecimal output from the counter 30 can be used, for example. The following table relates the hexidecimal output of the counter 30 to the states of the ballasts 16 and their corresponding lamps 18 in a sequential manner. "A" is the least significant bit. For example, if all of the lights are off and a user control interface 26 such as a toggle-type wall switch is switched ON and then OFF once, two lamps 18 are illuminated. A user can then toggle the switch one, two, and three more times to have four, six and then eight lamps powered on. Another operation of the toggle switch serves to power all of the lamps 18 down again.

| A | B | C | D | Number of Ballasts Powered | Number of Lamps Operating |
|---|---|---|---|---|---|
| 0 | 0 | 0 | 0 | 0 | 0 |
| 1 | 0 | 0 | 0 | 1 | 2 |
| 0 | 1 | 0 | 0 | 2 | 4 |
| 1 | 1 | 0 | 0 | 3 | 6 |
| 0 | 0 | 1 | 0 | 4 | 8 |
| 1 | 0 | 1 | 0 | 0 (counter reset) | 0 (counter reset) |

Figure 4:
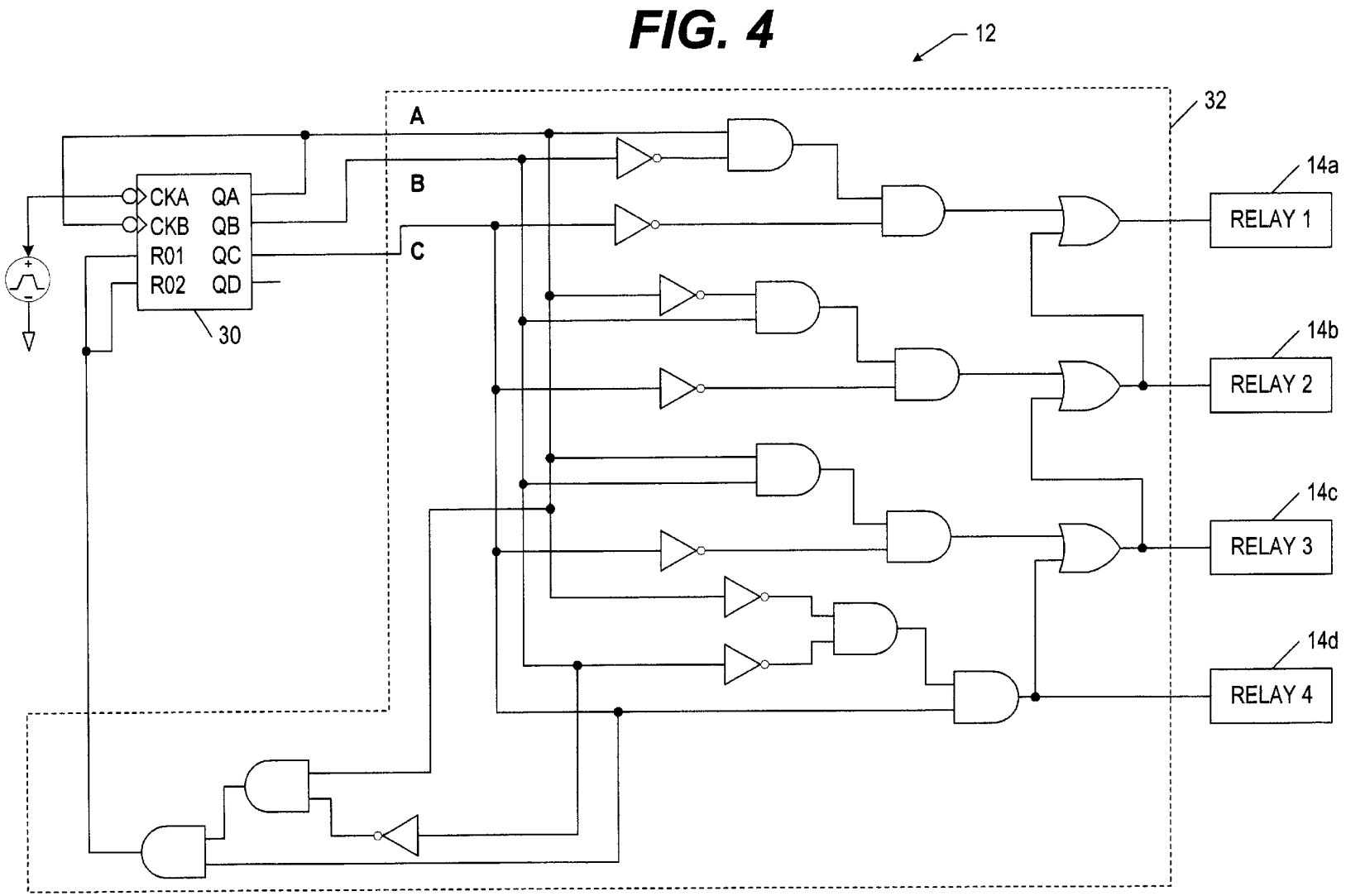
FIG. 4 is a schematic diagram of a ballast control device constructed to implement the truth table of FIG. 3 in accordance with an embodiment of the present invention.

A truth table for the required logic is shown in FIG. 3. Only counter outputs A, B and C are used since only four ballasts are being controlled in the illustrated example. A "0" in the truth table corresponds to an open relay and therefore to no power being provided to the lamps from the ballast. A "1" in the truth table corresponds to a closed relay and therefore to power being provided to the lamps from the ballast. As can be understood from FIG. 3, if Relay #4 is closed, then all of the other relays are closed. Further, if Relay #3 is closed, then Relay #2 and Relay #1 are also closed, but not Relay #4. This pattern of relay operation is the basis for the exemplary logic illustrated in FIG. 4.

The sequence of switching can also be reversed in accordance with another embodiment of the present invention. The following table relates the hexidecimal output of the counter 30 to the states of the ballasts 16 and their corresponding lamps 18 in a sequential manner. "A" is the least significant bit.

| A | B | C | D | Number of Ballasts Powered | Number of Lamps Operating |
|---|---|---|---|---|---|
| 0 | 0 | 0 | 0 | 0 | 0 |
| 1 | 0 | 0 | 0 | 4 | 8 |
| 0 | 1 | 0 | 0 | 3 | 6 |
| 1 | 1 | 0 | 0 | 2 | 4 |
| 0 | 0 | 1 | 0 | 1 | 2 |
| 1 | 0 | 1 | 0 | 0 (counter reset) | 0 (counter reset) |

Figure 6:
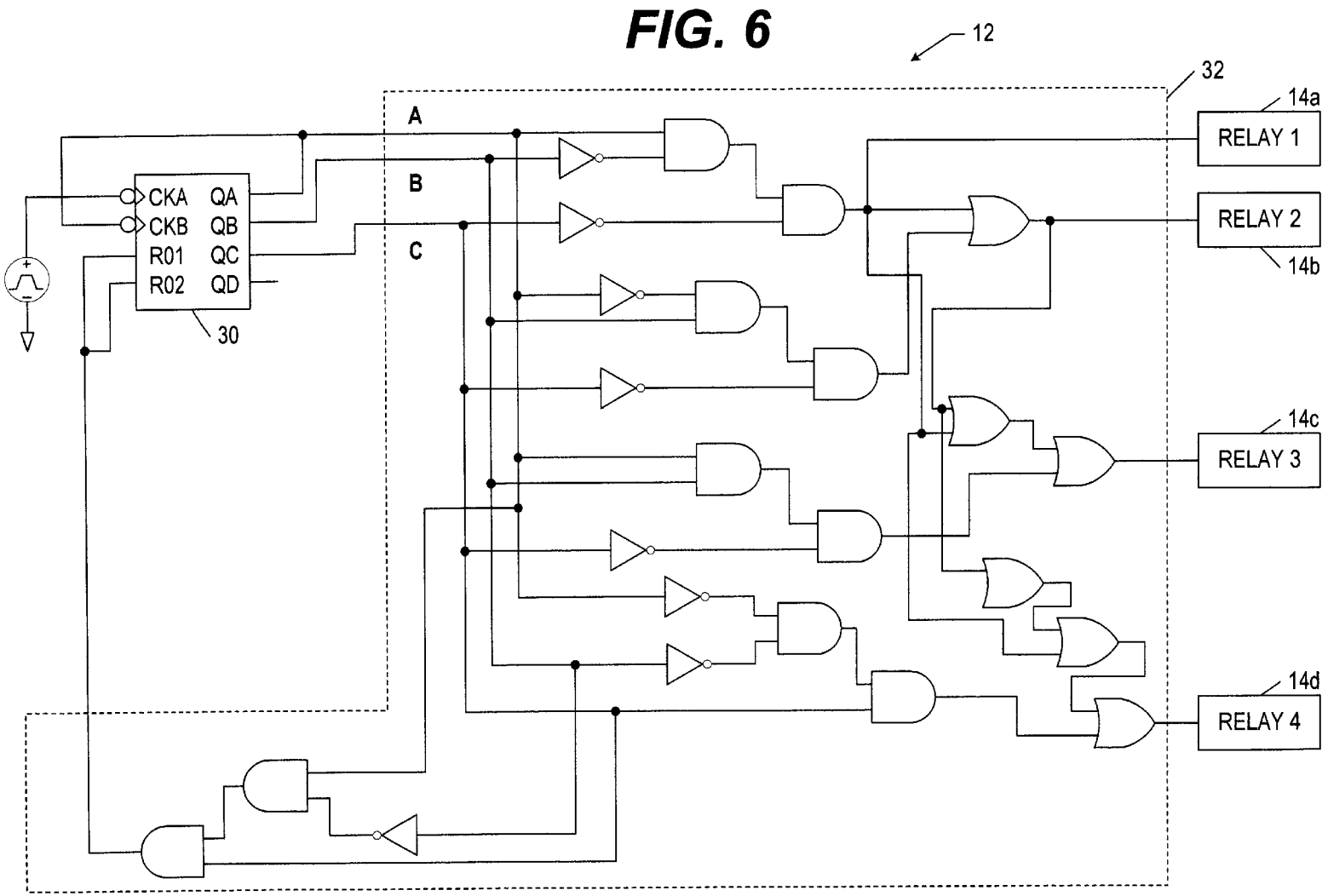
FIG. 6 is a schematic diagram of a ballast control device constructed to implement the truth table of FIG. 5 in accordance with an embodiment of the present invention.

A truth table for the required logic is shown in FIG. 5. As can be understood from FIG. 5, of Relay #1 is closed, then all of the other relays are closed. Further, if Relay #2 is closed, then Relay #3 and Relay #4 are also closed, but not Relay #1. This pattern of relay operation is the basis for the logic illustrated in FIG. 6 The decoder and counter combination depicted in FIGS. 4 and 6 can be implemented as a gate array burned into field programmable gate array (FPGA) or similar device. In any case, the logic for selecting which relay(s) 14 and corresponding ballast(s) 16 to operate in response to a change in a control signal (e.g., a pulse or interrupt in the control signal) that is exemplified in FIGS. 4 and 6 can be manufactured less expensively than employing the use of a programmable integrated circuit such as a microcontroller or microprocessor.

The counter 30 and decoder 32 ate economical for lighting control applications that use fixed control of the ballasts 16 and their corresponding lamps 18, that is, applications that select the same ballasts in the same order within each cycle of the control signals (e.g., in response to consecutive control signal pulses, power all ballasts on, then open the relay to ballast #3, then open the relay to ballast #2 and so on until all ballasts are off, then power all ballasts on again). The lighting control system 10, however, can also provide more complex ballast control operations. For example, in the control devices 12 illustrated in FIGS. 4 and 6, some lamps age more rapidly than others (e.g., the first pair of lamps) and would therefore have to be replaced more frequently unless all of the lamps 18 are powered on whenever the luminaire 20 is used. In accordance with another embodiment of the present invention, the control device 12 is implemented using a programmable device 34 (e.g., a microprocessor or microcontroller) to determine which of the ballasts 16 in a multi-ballast and multi-lamp luminaire 20 to operate to illuminate the lamps connected thereto. The programmable device 34 can be programmed, for example, to alternate which of the lamps 18 are the primary pair of lamps that is operated when operation of only two of the lamps is desired. Further, the programmable device 34 can be programmed to alternate which of the lamps 18 are the secondary and third pairs of lamps that ate operated when operation of four and six of the lamps, respectively, is desired.

Figure 7:
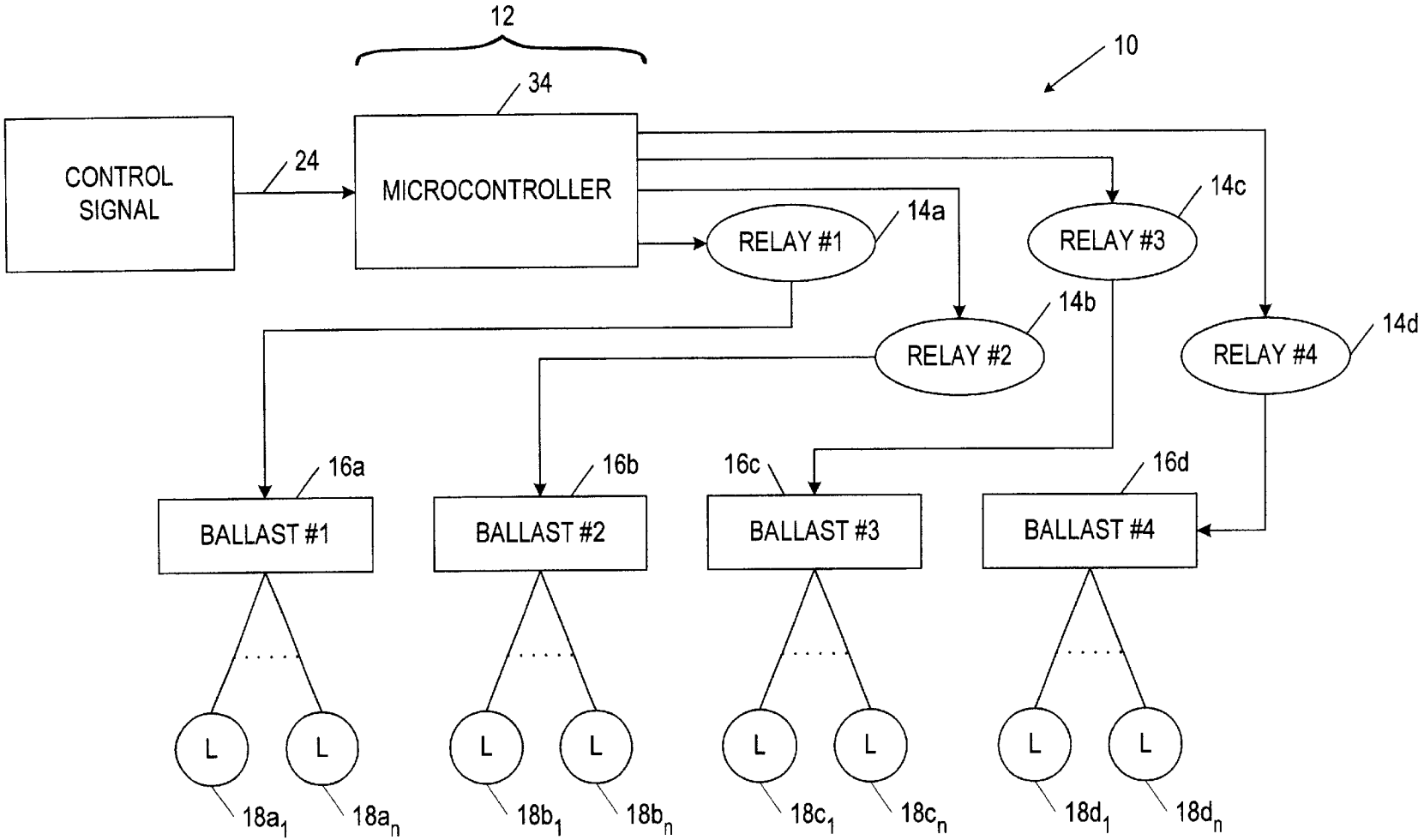
FIG. 7 is a block diagram of a ballast control device constructed in accordance with an embodiment of the present invention.

As shown in FIG. 7, the control device 12 can comprise a microcontroller which can provide separate control outputs to respective ones of the relays 14. As shown in the following table, the microcontroller can be programmed to operate a subset of three ballasts 16 and their corresponding lamps 18 on a particular day, or only one ballast and its lamps on a different day. Further, the microcontroller can be programmed to alternate which ballasts constitute the multiple ballast subset and which of the ballasts is to operate alone, as illustrated for Days 3 and 4 in the table below. As stated previously, the illustrated embodiment is described in connection with an exemplary luminaire comprising four ballasts and two lamps for each ballast. It is also to be understood that the present invention can be employed with different numbers of lamps, ballasts and luminaires, as well as different configurations such as the sharing of ballasts between lamps of different luminaires.

| Initialization of Luminaire Operation | Ballast(s) Operating |
|---|---|
| Day 1 | #1, #2, #3 |
| Day 2 | #1 |
| Day 3 | #2, #3, #4 |
| Day 4 | #4 |

In accordance with the present invention, the control device 12 receives or generates control signals to operate selected relays 14 and, correspondingly, their respective ballasts 16 and lamps 18 in preferably a manner that rotates lamp usage to more evenly distribute lamp burn times. For example, the control device 12 can receive control signals from a user control interface 26 such as a wall-mounted light switch. The microcontroller 34 can be programmed to interpret each pulse, or high-to-low or low-to-high transition, or interrupt in the control signal transported via the control input 24 as an instruction to change the states of the ballasts 16 in the luminaire 20. The microcontroller 34, in turn, generates an output signal on or more of its pins connected to respective relays 14.

It is also to be understood that the microcontroller 34 can be programmed to select which ballasts to operate in response to the control signal on the control input 24, as well as on the basis of other factors such as date and/or time of day, or in which of a number of zones the luminaire 20 operates, or which lamps have undergone the most burn time, and so on. For example, the microcontroller 34 can be programmed to vary which ballasts 16 are operated in response to changes in the control signal regardless of the actual burn times of the lamps. In other words, the ballasts #1, #2 and #3 in the previous example, can be powered on for a period of eight hours on Day 1 and then be powered on for only two hours on Day 5 in the next cycle, depending on a user's need for lighting. The microcontroller 34 can also be programmed to track the selection of ballasts 16 and the actual burn times of the lamps 18 and use this stored information when selecting ballasts 16 for operation. In addition, the microcontroller can be programmed to perform sequential operation of the ballasts in a manner similar to the counter and decoder described above, that is, to operate the same ballasts in the same order within each cycle of the control signal (e.g., power down all four ballasts in response a pulse, power up ballast 16*a* in response to the next pulse, power up ballast 16*b* in response to the next pulse, and so on until all ballasts are powered down again).

When the control device 12 is implemented using programmable logic as exemplified in FIG. 7, the luminaires in the lighting control system 10 can be addressable in accordance with another aspect of the present invention. For example, each microcontroller 34 in a plurality of luminaires 20 can be assigned an address. A master controller, or distributed control among the microcontrollers 34, can then be used to send commands including one or more addresses to the luminaires 20 via their control inputs 24. Each microcontroller, in turn, can examine a received command and respond with programmed control of corresponding relay(s) 14 if the command is addressed to it. Thus, the luminaires can be arranged in different zones within a facility.

Although several exemplary embodiments of the present invention have been described in detail above, those skilled in the art will readily appreciate that many modifications ate possible in the exemplary embodiments without departing from the novel teachings and advantages of this invention. Accordingly, all such modifications are intended to be included within the scope of this invention as defined in the following claims.

What is claimed is:

1. A luminaire having a plurality of ballasts connected to a plurality of lamps and further comprising:

a plurality of relays connected to respective ones of the plurality of ballasts;

a control device connected to each of said plurality of relays; and a control input for providing a control signal to said control device, said control device comprising a counter for counting and generating an output signal in response to said control signal and a decoder configured to receive said output signal and sequentially select which of said plurality of relays to actuate and thereby operate the corresponding ones of the plurality of ballasts in response to said output signal;

wherein said control signal is a DC signal comprising pulses, said counter being operable to increment said output signal in response to each pulse, said decoder being configured to implement a truth table whereby all of the plurality of ballasts are powered on in response to a first one of said pulses, and then one or more subsets of the plurality of ballasts are powered down in response to subsequent ones of said pulses until all of the plurality of ballasts are powered down.

2. A luminaire as claimed in claim 1, wherein all of the plurality of ballasts are powered on again in response to the next one of said pulses and then powered down in said one or more subsets in the same order as before in response to subsequent ones of said pulses.

3. A luminaire as claimed in claim 1, wherein said control signal is generated via a user control interface selected from the group consisting of a wall-mounted light switch, a toggle switch, a slide switch, a dial and a clock.

4. A luminaire having a plurality of ballasts connected to a plurality of lamps and further comprising:

a plurality of relays connected to respective ones of the plurality of ballasts;

a control device connected to each of said plurality of relays; and a control input for providing a control signal to said control device, said control device comprising a counter for counting and generating an output signal in response to said control signal and a decoder configured to receive said output signal and sequentially select which of said plurality of relays to actuate and thereby operate the corresponding ones of the plurality of ballasts in response to said output signal;

wherein said control signal is a DC signal comprising pulses, said counter being operable to increment said output signal in response to each pulse, said decoder being configured to implement a truth table whereby all of the plurality of ballasts are powered down in response to a first one of said pulses, and then one or more subsets of the plurality of ballasts are powered on in response to subsequent ones of said pulses until all of the plurality of ballasts are powered on.

5. A luminaire as claimed in claim 4, wherein all of the plurality of ballasts are powered down again in response to the next one of said pulses and then powered on in said one or more subsets in the same order as before in response to subsequent ones of said pulses.

6. A luminaire as claimed in claim 4, wherein said control signal is generated via a user control interface selected from the group consisting of a wall-mounted light switch, a toggle switch, a slide switch, a dial and a clock.

7. A luminaire having a plurality of ballasts connected to a plurality of lamps and further comprising:

a plurality of relays connected to respective ones of the plurality of ballasts;

a control device connected to each of said plurality of relays; and a control input for providing a control signal to said control device to operate the luminaire in at least one state corresponding to the operation of a predetermined number of the plurality of ballasts that is less than the plurality of ballasts, said control device comprising a programmable controller that is programmed to sequentially select which of said plurality of relays to actuate and thereby operate the corresponding ones of the plurality of ballasts in response to said control signal, said programmable controller being operable to select and vary which of the plurality of ballasts to operate in the at least one state to distribute the burn times of said plurality of lamps.

8. A luminaire as claimed in claim 7, wherein said control signal is generated via a user control interface selected from the group consisting of a wall-mounted light switch, a toggle switch, a slide switch, a dial and a clock.

9. A luminaire as claimed in claim 7, wherein said programmable controller is operable to alternate which of the plurality of ballasts to operate via the corresponding ones of said plurality of relays in accordance with factors selected from the group consisting of date, time of day, and burn times of respective ones of said plurality of lamps.

10. A luminaire as claimed in claim 7, wherein said luminaire can be operated with respect to a plurality of luminaires that are connected to the same control input and assigned to different zones, said programmable controller is assigned an address and said control signal comprises at least one of a plurality of addresses, said programmable controller being programmable to operate in at least one of said zones in response to said control signal if said control signal comprises said address.

11. A method of selectively operating a plurality of ballasts connected to a plurality of lamps, the method comprising the steps of:

generating a control signal to provide control information for operating each of said plurality of ballasts, each of said plurality of ballasts being connected to at least one lamp from said plurality of lamps to control power provided to said at least one lamp; and providing said control signal to a control device connected to each of a plurality of relays that are connected to respective ones of said plurality of ballasts, said plurality of relays being operable to open or close in response to said control device to selectively power up and power down corresponding ones of said plurality of ballasts, said control device being operable to provide for power up of all, none and subsets of said plurality of lamps over a period time; and varying which of said plurality of ballasts to operate in at least one of said subsets of said plurality of lamps to distribute the burn times of said plurality of lamps.

12. A method as claimed in claim 11, wherein said plurality of relays are operable to selectively complete and interrupt the supply of power from a power source to corresponding ones of said plurality of ballasts in response to said control signal.

13. A method as claimed in claim 11, wherein said plurality of ballasts are electronic and said plurality of relays are operable to render corresponding ones of said plurality of ballasts operational and nonoperational in accordance with said control signal.

14. A method as claimed in claim 11, wherein said control information comprises a selected binary state for respective ones of said plurality of ballasts.

15. A method as claimed in claim 11, wherein said plurality of ballasts and said plurality of lamps are located in the same luminaire.

16. A method as claimed in claim 11, wherein respective ones of said plurality of ballasts are distributed among more than one luminaire.

17. An apparatus for operating a plurality of ballasts connected to a plurality of lamps comprising:

a plurality of relays connected to corresponding ones of said plurality of ballasts;

a control device connected to said plurality of relays and being operable to generate a control signal to control each of said plurality of relays, said ballasts being connected to at least one lamp from said plurality of lamps to control power provided to said at least one lamp, said plurality of relays being operable to open or close in accordance with said control signal to render selected ones of said plurality of ballasts operational and nonoperational;

wherein said control signal can provide for power up of all, none and subsets of said plurality of lamps over a period time, and said control device is operable to vary which of said plurality of ballasts to operate in at least one of said subsets of said plurality of lamps to distribute said burn times among said plurality of lamps.

18. An apparatus as claimed in claim 17, wherein said control device comprises a programmable processing device having output lines connected to respective ones of said plurality of relays and being programmable in response to said control signal to power on selected ones of said plurality of ballasts via said plurality of relays.

19. An apparatus as claimed in claim 17, wherein said control device is operable to determine which of said plurality of ballasts to operate to ensure that burn time of said plurality of lamps is distributed substantially evenly among each of said plurality of lamps during said period of time.

* * * * *